US008267026B2

(12) United States Patent
Pelerin et al.

(10) Patent No.: US 8,267,026 B2
(45) Date of Patent: Sep. 18, 2012

(54) PASSENGER SHIP WITH OUTER PASSAGEWAYS PROVIDED WITH VENTILATION MEANS

(75) Inventors: Erick Pelerin, Saint Nazaire (FR); Thibaut Tincelin, Nantes (FR)

(73) Assignee: STX France S.A., Saint Nazaire (FR)

( * ) Notice: Subject to any disclaimer, the term of this patent is extended or adjusted under 35 U.S.C. 154(b) by 335 days.

(21) Appl. No.: 12/604,646

(22) Filed: Oct. 23, 2009

(65) Prior Publication Data

US 2010/0107951 A1 May 6, 2010

(30) Foreign Application Priority Data

Nov. 5, 2008 (FR) ..... 08 57523

(51) Int. Cl.
*B63B 3/00* (2006.01)

(52) U.S. Cl. ..... 114/65 R

(58) Field of Classification Search ..... 114/65 R
See application file for complete search history.

(56) References Cited

U.S. PATENT DOCUMENTS

| | | | | |
|---|---|---|---|---|
| 2,683,408 | A | 7/1954 | Brown et al. | |
| 4,106,249 | A * | 8/1978 | Morton | 52/336 |
| 4,838,190 | A * | 6/1989 | Levander | 114/56.1 |
| 5,715,636 | A * | 2/1998 | Taylor | 52/308 |
| 5,915,321 | A | 6/1999 | Fountaine | |
| 6,912,965 | B2 * | 7/2005 | Leitch et al. | 114/61.12 |
| 7,617,641 | B2 * | 11/2009 | Landey | 52/177 |
| 2002/0194806 | A1 * | 12/2002 | Roen | 52/506.01 |
| 2004/0177577 | A1 * | 9/2004 | Voegele et al. | 52/306 |

FOREIGN PATENT DOCUMENTS

| | | |
|---|---|---|
| EP | 0 703 139 A1 | 3/1996 |
| JP | 58 078894 A | 5/1983 |
| WO | WO 99/58399 A1 | 11/1999 |

* cited by examiner

*Primary Examiner* — Stephen Avila
(74) *Attorney, Agent, or Firm* — Pauley Petersen & Erickson

(57) ABSTRACT

A passenger ship includes at least one superstructure having several superposed decks. At least some of the decks include contiguous passenger cabins having an outer longitudinal passageway, which extends between the latter and the hull. Each outer passageway is at least partly closed along its longitudinal side opposite to the cabins. At least one of the opposite ends of each outer passageway is open. The floor which separates outer passageways of two superposed decks is at least partly slatted. The ship includes air-conditioning for the cabins, with discharge of the treated air from the cabins towards the outside world, via said outer passageways. The passenger ship ensures ventilation of the passageways along both longitudinal and vertical directions, respectively, and with the air-conditioning.

12 Claims, 2 Drawing Sheets

PASSENGER SHIP WITH OUTER PASSAGEWAYS PROVIDED WITH VENTILATION MEANS

BACKGROUND OF THE INVENTION

1. Field of the Invention

The present invention relates to a passenger ship.

2. Discussion of Related Art

Traditionally, such ships include at least one superstructure consisting of several superposed decks, at least one portion of which consists of passenger cabins.

These passenger cabins, whether they are "blind" (i.e. without any view on the sea) or not (which means that they include at least one picture window for having a view on the sea) are accessible from passageways, i.e. long corridors.

These corridors are longitudinally delimited by walls common to the cabins into which they lead. They therefore form inner circulation areas, which do not provide any added value in terms of pleasantness.

These cabins, as well as the associated passageways, are as many public spaces which are traditionally supplied with air-conditioning.

Thus, under winter navigation conditions, they are supplied with heated-up air.

On the contrary, under summer navigation conditions, they are supplied with freshened air.

This is achieved with air-conditioning means.

Now, everybody knows that such means are large energy consumers. And because of the increase in the price of fossil energies, the navigation sector is itself forced to reduce its consumption of such energies as much as possible.

Moreover, passenger ships are known, which are equipped with "promenade decks", i.e. passageways which run along the hull and which are directly open on the outside.

SUMMARY OF THE INVENTION

The present invention aims at solving the problem indicated above, by proposing a passenger ship for which the energy consumption level for conditioning the air, which is used therein, is reduced, without affecting the comfort of the passengers.

Thus, this passenger ship, which includes at least one superstructure consisting of several superposed decks, at least one portion of which consists of passenger cabins, some of these cabins being contiguous, on the associated deck, with an "outer" longitudinal passageway, which extends between the latter and the hull, is essentially characterized by the fact that:

- each outer passageway is at least partly closed along its longitudinal side opposite to the cabins;
- at least one of the opposite ends of each outer passageway is open;
- the floor which separates outer passageways of two superposed decks is at least partly slatted;
- the ship includes air-conditioning means for said cabins, with outward discharge of the treated air of the cabins, via said outer passageways, the combination of these above features permitting to ensure ventilation of said passageways along longitudinal, vertical directions respectively and with said air-conditioning means.

With the "closure" of the outer passageways along their side opposite to the cabins, a circulation space protected from the outside world, notably from bad weather, may be provided to the passengers. Further, the air circulation which is arranged therein provides the passengers with real wellness, without it being necessary to directly blow conditioned air therein, i.e. without spending energy unnecessarily.

According to other advantageous and non-limiting features:

- each outer passageway is closed along its longitudinal side opposite to the cabins by transparent or translucent, for example glass-paned walls;
- at least one portion of said walls is movable, so as to allow air to pass from inside the passageways to the outside world and vice versa;
- said outer passageway includes means for blanking out light, notably Venetian blinds;
- the outer passageways of two superposed decks are connected together, at, at least one of their opposite ends, by a staircase which communicates with the outside world;
- said floor consists in a grating;
- said cabins directly communicate with said associated outer passageway, i.e. they include an access means such as a door accessible from the passageway;
- said means for conditioning air comprise means for treating the latter with view to discharging it into said outer passageway;
- the ship consists in a trimaran, said superstructure extending at least over a portion of its central and main hull;
- said air-conditioning means comprise means for sucking up fresh air which ensure that this air is picked up in the space located between said main hull and its floats.

Other features and advantages of the present invention will become apparent upon reading the description which follows of a preferential embodiment.

BRIEF DESCRIPTION OF THE DRAWINGS

This description will be given with reference to the appended drawings wherein.

DESCRIPTION OF PREFERRED EMBODIMENTS

The ship illustrated in the appended figure is a trimaran. However the present invention applies to any type of passenger ship and most particularly to single-hulled vessels.

Figure 1:
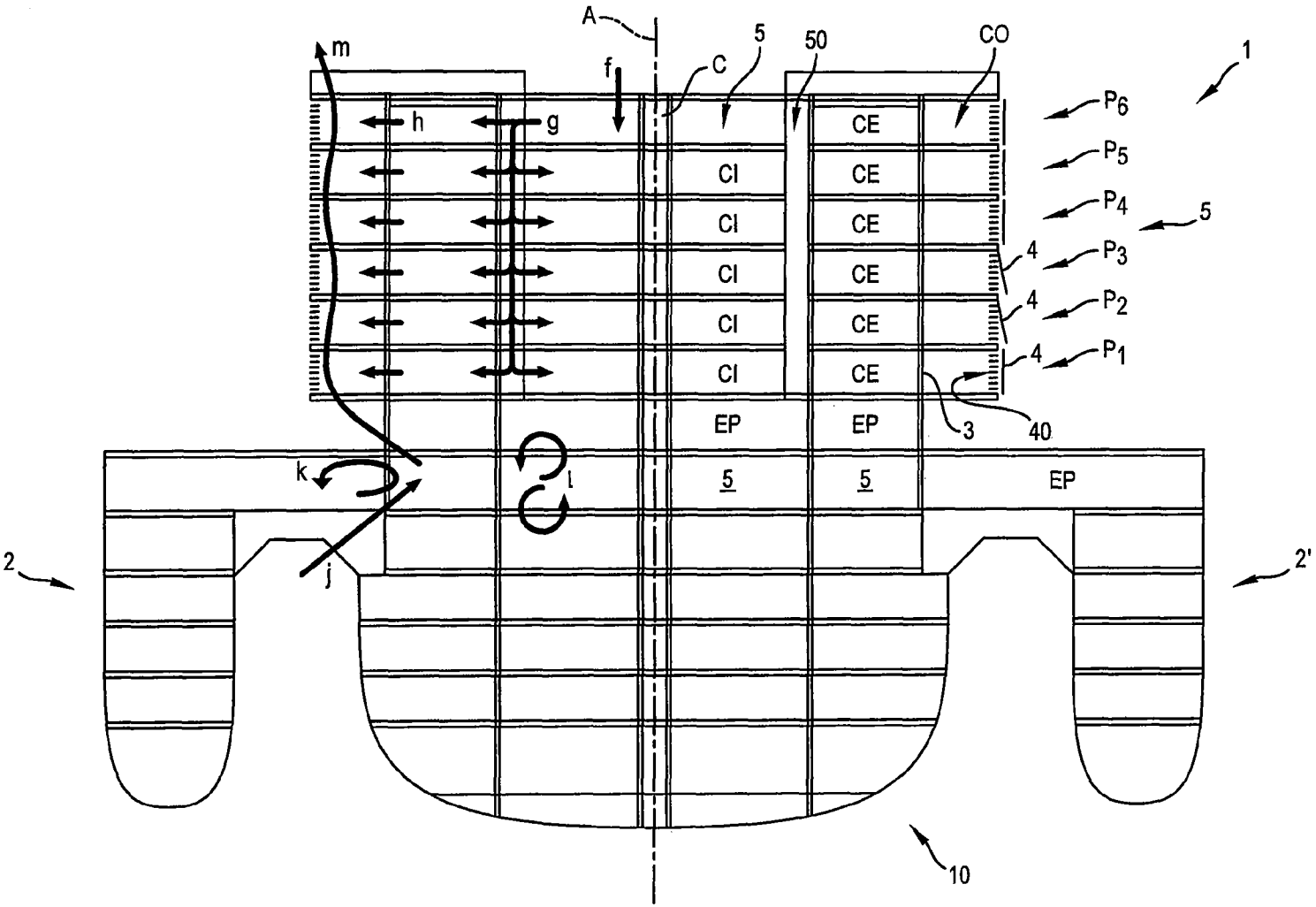
FIG. 1 is a schematic vertical cross-sectional view of a ship according to the invention.

The trimaran 1 illustrated in FIG. 1 includes a central and main hull 10 and two auxiliary hulls 2 and 2' forming floats. The latter are connected to the main hull through linking arms.

The longitudinal plane of symmetry of the ship is referenced as A.

For the sake of the clarity of the figure, only the right portion of the latter bears numerical references, while only the left portion has arrows illustrating the circulating flow of air in the ship.

However, of course, these numerical references and arrows are both valid for either portion of the ship, because of the perfect symmetry of the latter relatively to the aforementioned plane A.

The main hull of the ship 1 includes a superstructure S which consists of several superposed decks referenced as P1-P6.

Of course, in non-illustrated embodiments, this number of superposed decks may be different, both less than and greater than six.

Traditionally, this superstructure receives a high number of passenger cabins.

Those located the closest to the plane of symmetry of the ship are described as "inner cabins" CI and passageways or corridors C lead to them, and separate two by two the inner cabins which face each other.

Moreover, the passenger cabins which are positioned as close as possible to the rim of the hull of the ship are referenced as CE.

These CE cabins are contiguous on the associated deck with an outer longitudinal passageway CO which extends between it and the hull, as shown by FIG. 1.

In other words, the passageways CO of the decks P1-P6 are superposed.

According to a feature of the invention, each outer passageway CO is at least closed along its longitudinal side opposite to the CE cabins.

In the example illustrated here, these passageways are closed by transparent or translucent, for example glass-paned, walls 4.

Thus, the passengers who circulate in these passageways CO are isolated from the outside world by said walls, while benefiting from the outdoor light. When these walls are transparent, they also allow a direct view on the sea.

According to a preferred embodiment, at least one portion of these walls 4 is movable, so as to allow air to pass from the inside of the CO passageways to the outside world and vice versa.

This opening/closing of the walls may be achieved automatically, for example by using means which will trigger this opening/closing, notably depending on the outdoor temperature and/or on the force of the wind, and/or its direction.

Advantageously, these CO passageways include means for blanking out the light, notably Venetian blinds 40.

There again, deployment of these blinds may be achieved automatically depending on the outdoor luminosity and/or sun intensity.

In a different and non-illustrated embodiment, these may be other means such as sliding panels.

By means of this equipment, the CO passageways form as many circulation spaces for the passengers who may walk along them safely and with great comfort.

When the passageways have a large width, for example of the order of 2.50 m, they contribute to generating more shade in the direction of the cabins.

Although this is not illustrated, the outer CO passageways of two superposed decks, for example the decks P1 and P2 are connected together at least at one of their opposite ends, by a staircase which communicates with the outside world.

Under these conditions, at least one of these ends is open so that outdoor air may circulate therein horizontally and longitudinally, which contributes to renewing and conditioning the air which is found there.

Figure 2:
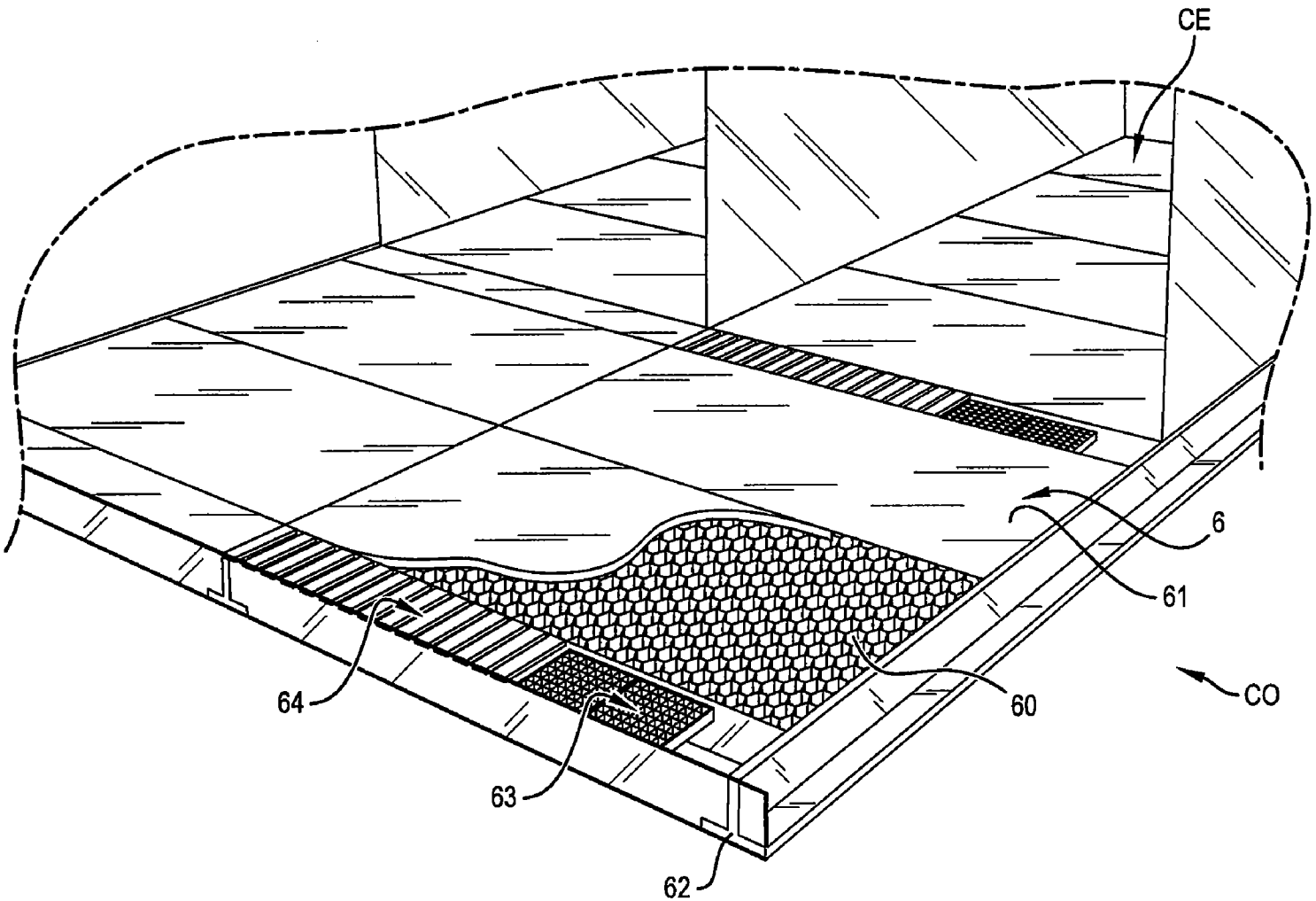
FIG. 2 is a partial perspective view of a floor which equips a passageway of said ship.

Moreover, and according to another feature of the invention, the floor 6, notably visible in FIG. 2, which separates two outer CO passageways of two superposed decks, is at least partly slatted.

As indicated, this floor 6 visible in FIG. 2, consists of a network of constitutive metal girders 62 of the associated deck, between which honeycomb structures 60 are placed, covered with a circulation floor 61.

However, in the example illustrated here, this floor in fact consists of a slatted grating since a longitudinal portion of the latter consists of a widely open grid 63 covered with protective mesh 64.

By means of this structure, the air which circulates in the passageways may freely move vertically from one passageway CO to the other in order to improve ventilation of the latter, with pleasant repercussion on the comfort of the passengers.

As shown in FIG. 1, the ship is equipped with air-conditioning means 5. These means are multiple and for example located in the upper portion of the superstructure S, as well as in the upper region of the main hull 10, as shown in FIG. 1.

The means 5 located in the upper portion of the superstructure S are connected by shafts 50 inside the passenger cabins CI and CE.

This circulating flow is illustrated by the arrows f and g of the left portion of FIG. 1.

Always according to a feature of the invention, these air-conditioning means include means for discharging the treated air of the cabins outwards via the outer passageway CO. This circulating flow is illustrated by the arrows h of the left portion of FIG. 1.

Thus, each CO passageway receives air along longitudinal, vertical directions and with the aforementioned conditioning means.

They form as many spaces which therefore do not have to be conditioned, which contributes to reducing the energy expenditure of the ship.

Further, under summer conditions and when they are of a great width, the shade which they generate contributes in lowering the general temperature inside the ship, so that the air-conditioning of the cabins does not have to be turned up excessively.

Preferentially, the CE cabins directly communicate with the corresponding outer passageway CO, which means that they include an access means, such as a door, accessible from said CO passageway.

Advantageously, the means for conditioning air 5 comprise means for treating the latter, such as a filter, with view to discharging it from the cabins towards the outer passageways CO.

The air-conditioning means 5 may include means for sucking up fresh air which ensure that this air is picked up in the space located between the main hull 10 and the floats 2 and 2'. The circulating air flow is illustrated by the arrow j, the fresh air being then treated by air-conditioning means 5 located at the hull and re-injected into public spaces EP located nearby (arrows j and k).

A portion of this conditioned air is then discharged into the passageways, as shown by the arrow m, through which it flows in the vertical direction through the floors.

The present invention may of course be applied to any type of ship, for example a pentamaran or a single-hulled vessel. In the latter case, the fresh air used for conditioning may be picked up at the level of the promenade decks.

We claim:

1. A passenger ship (1), which includes at least one superstructure (S) having several superposed decks (P1-P6), which include contiguous passenger cabins, on the associated deck, with an outer longitudinal passageway (CO), which extends between the latter and hull, the ship comprising:

each outer passageway (CO) is at least partly closed along its longitudinal side opposite to the cabins (CE);

at least one of the opposite ends of each outer passageway (CO) is open;

the floor (6) which separates outer passageways (CO) of two superposed decks is at least partly an open grid and permits air to move vertically from one passageway to the other;

the ship includes air-conditioning means (5) for said cabins (CE) with discharge of the treated air from the cabins to the outside, via said outer passageways (CO);

the combination of these above features ensuring ventilation of said passageways (CO) along longitudinal and vertical directions, respectively, and with said air-conditioning means (5).

2. The ship according to claim 1, wherein each outer passageway (CO) is closed along its longitudinal side opposite to the cabins (CI) by transparent or translucent walls (4).

3. The ship according to claim 2, wherein at least one portion of said walls (4) is movable, so as to allow air to pass from the inside of the passageway (CO) to the outside world and vice versa.

4. The ship according to claim 1, wherein said outer passageway (CO) includes means for blanking out light.

5. The ship according to claim 1, wherein said outer passageways (CO) of two superposed decks (P1-P6) are connected together at, at least, one of their opposite ends by a staircase, which communicates with the outside world.

6. The ship according to claim 1, wherein said floor (6) comprises a grating.

7. The ship according to claim 1, wherein said cabins (CE) directly communicate with said associated outer passageway (CO) via an access means such as a door accessible from the passageway (CO).

8. The ship according to claim 1, wherein said means (5) for conditioning air comprise means for treating the latter with view to it being discharged into said outer passageways (CO).

9. The ship according to claim 1, wherein the ship is a trimaran, said superstructure (S) extending at least over a portion of its central and main hull (10).

10. The ship according to claim 9, wherein said air-conditioning means (5) comprise means for sucking up fresh air, which ensure that this air is picked up in the space located between said main hull (10) and its floats (2, 2').

11. The ship according to claim 2, wherein the transparent or translucent walls are glass-paned.

12. The ship according to claim 4, wherein said means for blanking out light comprises Venetian blinds.

* * * * *